US006893254B2

(12) United States Patent
Jiang

(10) Patent No.: US 6,893,254 B2
(45) Date of Patent: May 17, 2005

(54) SAFETY AND FORCE SAVING LIGHTER

(75) Inventor: Yintu Jiang, Ningbo Cixi (CN)

(73) Assignee: Guoliang Lou, Zhejiang (CN)

( * ) Notice: Subject to any disclaimer, the term of this patent is extended or adjusted under 35 U.S.C. 154(b) by 0 days.

(21) Appl. No.: 10/712,011

(22) Filed: Nov. 14, 2003

(65) Prior Publication Data

US 2004/0146823 A1 Jul. 29, 2004

(30) Foreign Application Priority Data

Jan. 27, 2003 (CN) ..... 03228662 U

(51) Int. Cl.[7] ..... F23D 11/36
(52) U.S. Cl. ..... 431/153; 431/256
(58) Field of Search ..... 431/153, 255, 431/256

(56) References Cited

U.S. PATENT DOCUMENTS 6,200,130 B1 * 3/2001 Man ..... 431/153
6,733,277 B2 * 5/2004 Huang ..... 431/153
6,736,630 B1 * 5/2004 Miyanaga ..... 431/153
6,755,642 B2 * 6/2004 Zhang ..... 431/153
2002/0132201 A1 * 9/2002 Zhang ..... 431/153

* cited by examiner

*Primary Examiner*—Alfred Basichas
(74) *Attorney, Agent, or Firm*—Rabin & Berdo, P.C.

(57) ABSTRACT

The present invention relates to a improved technology of electronic lighter, it includes the gas valve assembly on casing, piezoelectric assembly and press trigger, characterized in that a strengthener is provided between piezoelectric assembly and press trigger; there is a push key on press trigger and a reset spring between push key and side wall of press trigger with a lobe at its bottom which has a position corresponding to the top of strengthener. The present invention has properties of effective controlling the operation state of press trigger, preventing from mistake manipulation, heightening the safety of lighter and pushing the press trigger with ease for being supplemented with a strengthener and realizing its matching with push key.

8 Claims, 4 Drawing Sheets

SAFETY AND FORCE SAVING LIGHTER

FIELD OF THE INVENTION

The present invention relates to an improved technology of electronic lighter with liquefied gas as its fuel.

BACKGROUND OF THE INVENTION

An electronic lighter is a kind of lighter device with inflammable gas such as butane and natural gas as its fuel, the concrete structure consists of casing (inner chamber of casing and sidewall form an oil tank to contain inflammable gas and to be for fixing relative parts), gas valve assembly, piezoelectric assembly and press trigger etc., a crow plate causing both to act coordinately is set between the gas valve assembly and piezoelectric assembly. The piezoelectric assembly includes piezoelectric pusher rod mounted in according to the normal way, ram and lower piezoelectric ceramic; gas valve assembly includes gas valve, fire adjusting ring and gas outlet needle etc. In operation, push down the press trigger to open the crow plate and the liquefied fuel is out from outlet assembly, meanwhile the piezoelectric pusher rod is pressed down, the high voltage electrospark is produced from piezoelectric ceramic to ignite fuel and thus the flame is turnout for employment.

The electronic lighter with this kind of structure has a drawback of difficulty manipulation and hard hand feeling for its press trigger propping directly against the top of piezoelectric pusher rod and a quite big force is needed when pushing the press trigger. In addition, above mentioned lighter is apt to be ignited to hurt children or even endanger the public safety in case of accidentally mistake manipulation, children playing or accidentally knocking against the press trigger by hard objects owning to its absence of safeguard mechanism and thus no restrictive to manipulation of press trigger. Meanwhile the gas valve may be opened to discharge inflammable gas in case of the press trigger is pushed down accidentally by external force and thus the hidden danger for safety is existed. So the requirement of setting safeguard mechanism in lighter has been raised by some countries and areas such as U.S.A, Canada, Australia and Europe countries.

BRIEF DESCRIPTION OF THE INVENTION

The technology problems to be resolved and technology task proposals in the present invention are proposed to eliminate the deficiency and drawback in traditional technology and provide a force saving electronic lighter with safeguard mechanism. It could decrease manipulation force, effectively control the operation state of press trigger, avoid mistake operation and fire disaster or accident from children playing.

The technology by the present invention has following constitution: A safety and force saving lighter, comprising casing, gas valve assembly on top of casing, piezoelectric assembly at one side of gas valve assembly and press trigger on top of piezoelectric assembly, a crow plate causing both to act coordinately is set between the said gas valve assembly and piezoelectric assembly, characterized in that a strengthener is provided between piezoelectric assembly and press trigger; A slot with a push key in it is set on the press trigger, there is a reset spring between push key and side wall of press trigger, a lobe is located at the bottom of it which has a position corresponding to the top of strengthener.

A safety and force saving lighter characterized in that the top of strengthener is propping with press trigger, the bottom spindle is installed on the casing, i.e. the spindle is installed on two sidewalls of casing, with a concave bayonet on the middle and the bayonet being seized onto the piezoelectric assembly.

By the "lever" effect of supplemental strengthener, the thumb force in ignition could be decreased effectively in manipulation and the force saving object be realized.

In normal condition (push key is in reset state), the bottom lobe of push key in press trigger slot is corresponding with the top of strengthener under action of the reset spring and the strengthener is propping directly against lobe, the moving of strengthener is restrained and the press trigger could not be pressed further also, leading to no operation of piezoelectric assembly and gas valve assembly, fire ignition could not be conducted and a "safeguard" object is therefore realized. In ignition, the push key must be translated to make the lobe and top of strengthener staggering, i.e. both positions do not coordinate further and not prop directly further, if the press trigger is pushed in this time, it may bring the strengthener to act and move piezoelectric pusher rod together with crow plate downward, the piezoelectric assembly and gas valve assembly will act after arriving to operation travel and this may ignite for fire. The mistake manipulation or fire disaster from children playing with the lighter could be avoided owing to both actions of translating push key and pushing press trigger simultaneously are needed to ignite for fire.

A safety and force saving lighter, characterized in that the push key is installed transversely onto the two ends of press trigger and able to move front and back (no left and right) along the slot of press trigger. This structure leads to a reasonable action direction of translating push key and pushing press trigger and conforms to action habit of thumb without obstructing each other.

A safety and force saving lighter, characterized in that there is a guide rib on the inner wall of press trigger and the strengthener presents a circular top surface, this kind of coordination relationship makes strengthener to move smoothly on guide rib with decreased resistance.

A safety and force saving lighter, characterized in that a stop block is fixed onto one side of lobe, it coordinates with guide rib and is helpful to restrain the translation distance of push key.

The present invention has the following technical effects by supplementing strengthener and making it to coordinate with the push key equipped safeguard mechanism:

(1) Force saving, easy, flexible and well hand feeling by the lever principle;

(2) In operation, push key equipped safeguard mechanism could control effectively the action state of press trigger and travel of strengthener in manipulation and the gas leakage from pushing press trigger directly to ignite inflammable gas or pushing the press trigger accidentally by external force may be avoided, so the mistake operation is prevented, the children manipulation difficulty is increased and the lighter safety is heightened.

BRIEF DESCRIPTION OF THE APPENDED DRAWINGS

Next, a further description will be made as to the present invention with the Specification Figures.

In Figures.: 1—liquefied gas, 2—sucker rod, 3—gas valve assembly, 4—adjusting ring, 5—gas outlet needle, 6—fire drawing spring, 7—piezoelectric conductor, 8—inner hood, 9—windbreak hood, 10—push key, 11—reset spring, 12—strengthener, 13—press trigger, 14—crow plate, 15—piezoelectric assembly, 16—rubber pad, 17—casing, 18—base cover, 19—guide rib, 20—lobe, 21—stop block.

DETAILED DESCRIPTION OF THE INVENTION

The following Specification Figures are cited to give a detailed description of the present invention.

Figure 1:
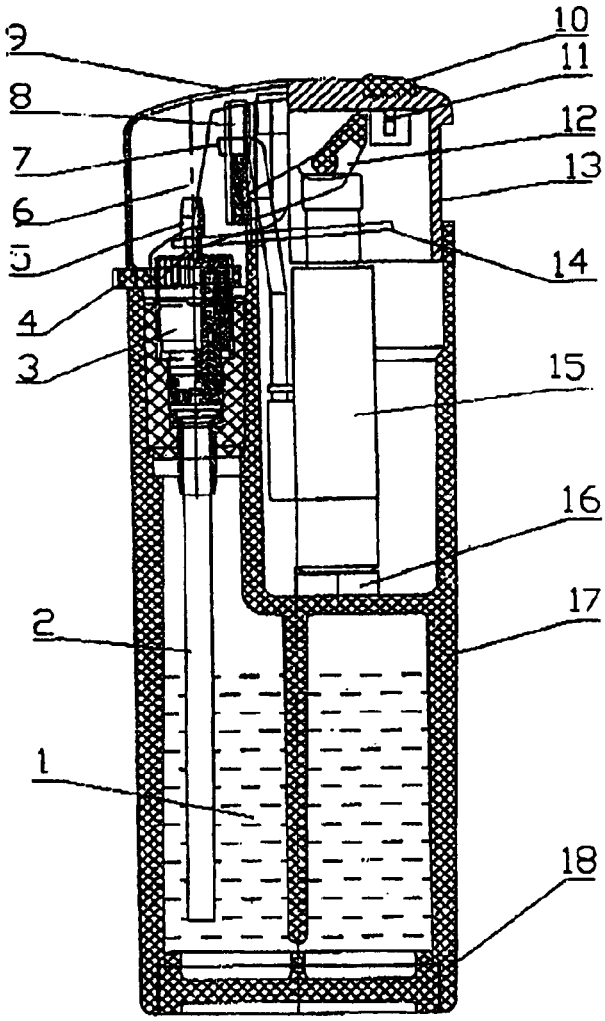
FIG. 1 is a normal state illustrative view showing the lighter in the present invention.
Figure 2:
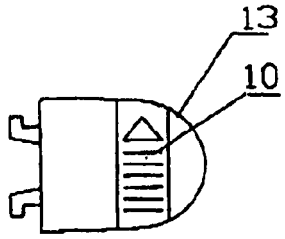
FIG. 2 is a push key position illustrative view showing the lighter in normal state in the present invention.
Figure 3:
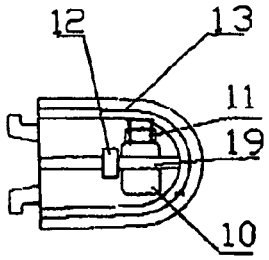
FIG. 3, FIG. 4 is a relative position illustrative view showing the push key, press trigger, strengthener, lobe and guide rib of lighter in normal state in the present invention (inverse state).
Figure 4:
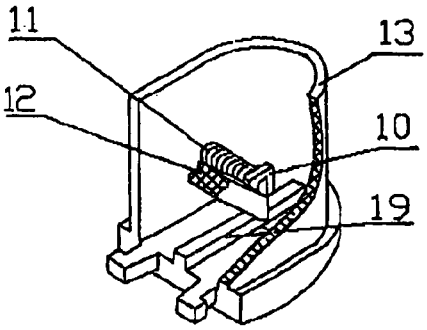
Figure 5:
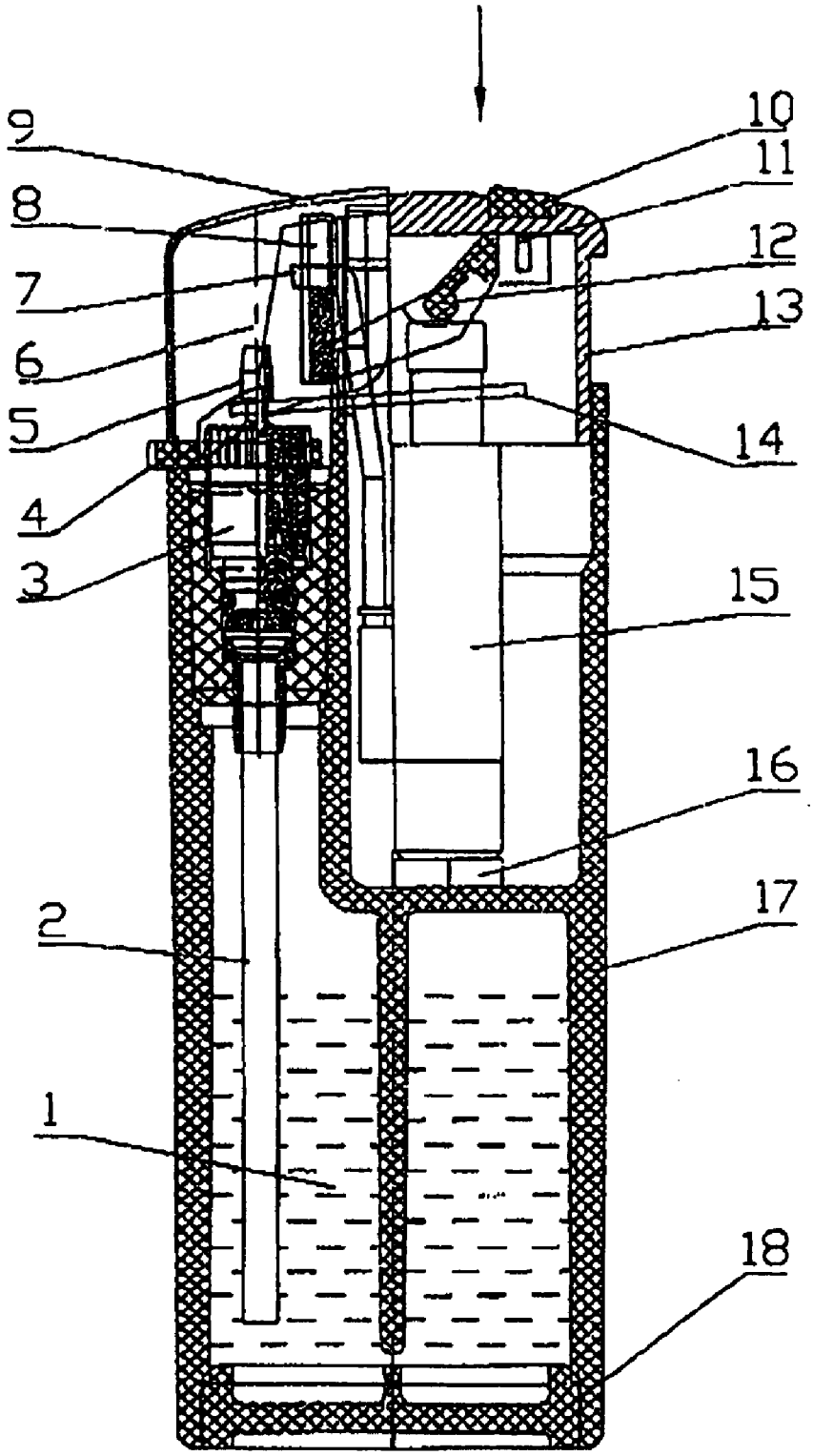
FIG. 5 is a no working state illustrative view showing the lighter in locking state in the present invention.
Figure 6:
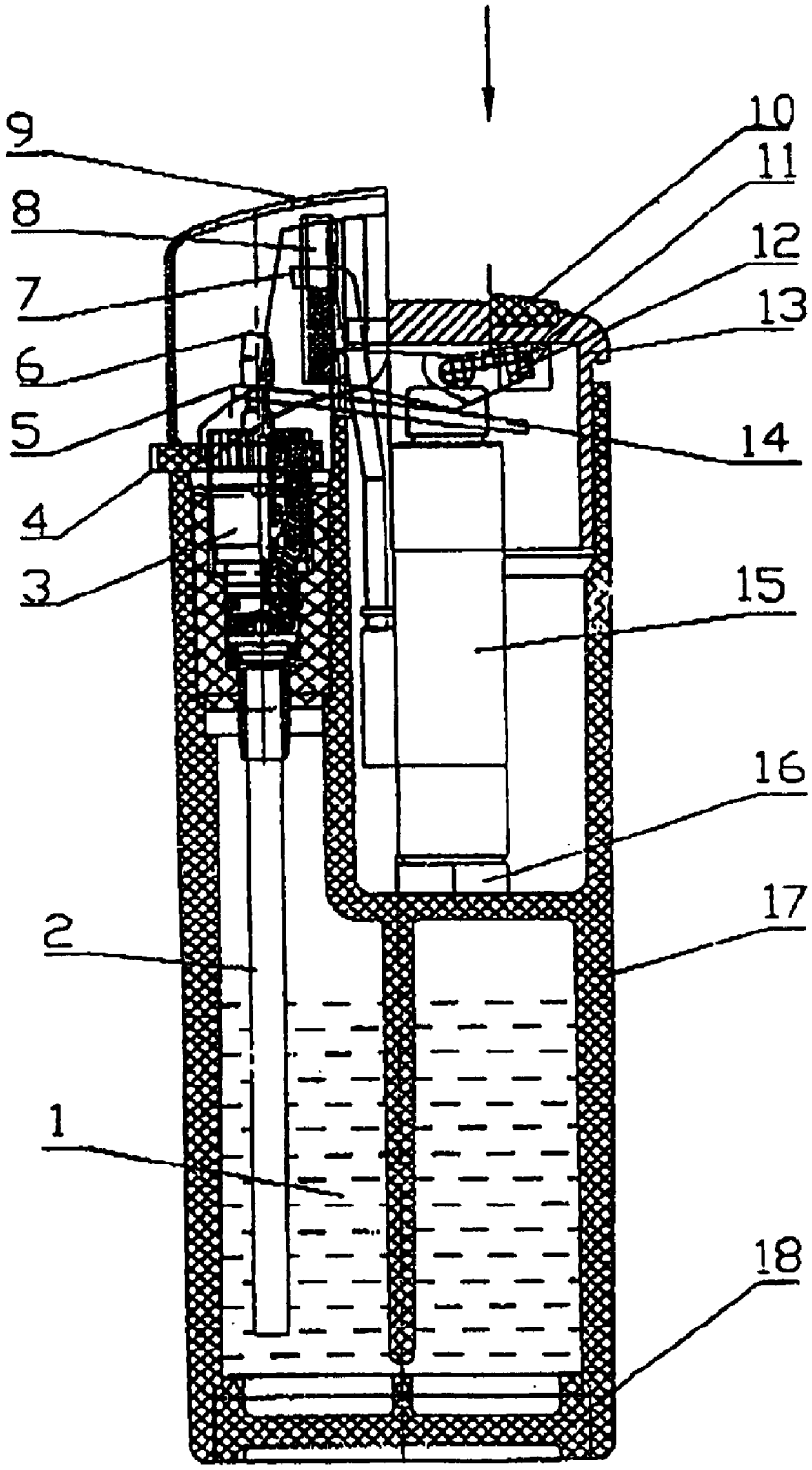
FIG. 6 is an illustrative view showing the lighter in working state in the present invention.
Figure 7:
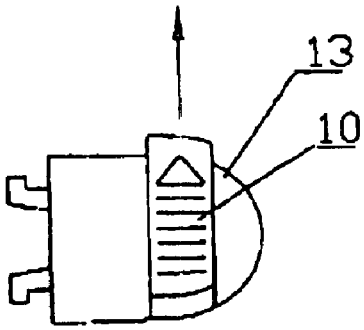
FIG. 7 is a push key position and translation direction illustrative view showing the lighter in working state in the present invention.
Figure 9:
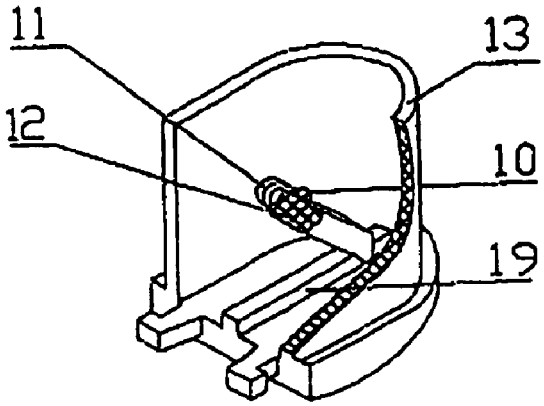
FIG. 8, FIG. 9 is a relative position illustrative view showing the push key, press trigger, strengthener, lobe and guide rib of lighter in working state in the present invention (inverse state).
Figure 8:
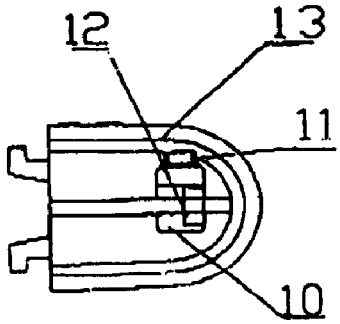
Figure 10:
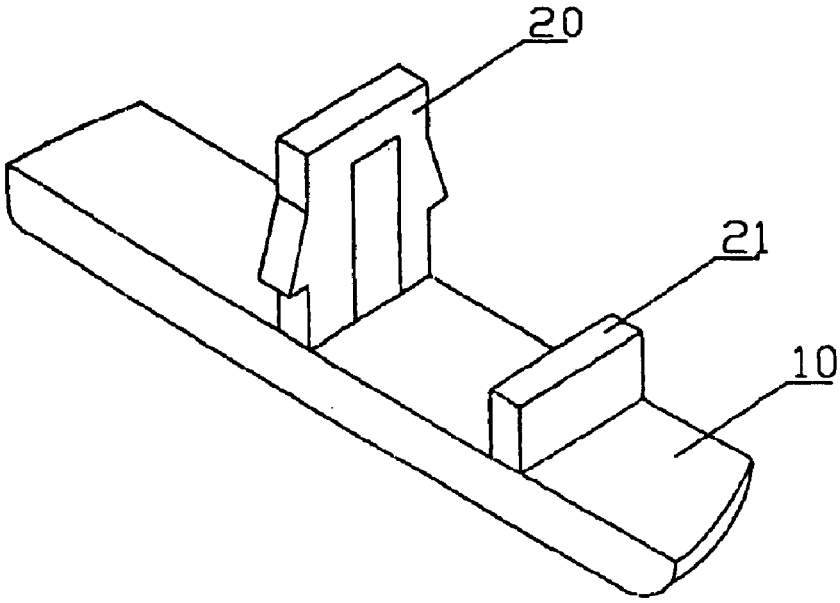
FIG. 10 is a push key structure illustrative view showing the lighter in the present invention.

Refer to FIG. 1, the safety and force saving lighter in the present invention is comprising casing 17 (the inner chamber may be divided into the oil tank containing liquefied gas 1 and the hollow chamber containing and fixing working parts and there is a base cover 18 on the bottom), gas valve assembly 3 on top of casing and in the containing hollow chamber (the gas valve assembly consists of normal sucker rod 2, gas valve 3, adjusting ring 4, gas outlet needle 5, fire drawing spring 6 etc.), piezoelectric assembly 15 at one side of gas valve assembly 3 (the piezoelectric assembly consists of normal piezoelectric push rod, piezoelectric conductor 7, inner hood 8, rubber pad 16 etc.), and press trigger 13 on top of piezoelectric assembly (windbreak hood 9 may be provided beside the press trigger ). A crow plate 14 causing both to act coordinately is set between the gas valve assembly 3 and piezoelectric assembly 15; strengthener 12 is provided between piezoelectric assembly and press trigger, the top of strengthener is propping with press trigger, the bottom spindle is installed on the two sidewalls of casing with a concave bayonet on the middle, the width of the bayonet is suitable to the one of piezoelectric pusher on top of piezoelectric assembly, the bayonet being seized onto the piezoelectric assembly. A slot with a push key in it is set on the press trigger (the push key is installed transversely onto the two ends of press trigger and able to move front and back), there is a reset spring 11 between push key and side wall of press trigger; there is a guide rib 19 on the inner wall of press trigger which coordinates with the circular top surface of strengthener and guide the motion of strengthener; there is a lobe 20 at the bottom of pusher key, a stop block 21 is fixed onto one side of the lobe, the lobe has a position corresponding to the motion direction face of strengthener in normal state(this motion direction face presents a coincidence surface with lobe).

When reset spring is in normal state, the bottom lobe of push key is propping directly against the motion direction face of strengthener, the moving of strengthener and pushing of press trigger are restrained, leading to no operation of piezoelectric assembly and gas valve assembly, the fire could not be ignited. In ignition, the push key is translated first and the reset spring is pressed, the lobe departs from the position corresponding to the circular top of strengthener along with the translating of push key and does not propping any more when two parts staggered, if the press trigger is pushed in this time, it may bring the strengthener to slide along with the guide rib and move piezoelectric pusher rod and crow plate downward easily, the piezoelectric assembly and gas valve assembly will act after arriving to operation travel and this may ignite for fire. After relieving the press trigger, reset spring resets the push key and the lighter is into safeguard state i.e. "normal state" again.

I claim:

1. A safety and force saving lighter, comprising a casing (17), a gas valve assembly (3) on top of the casing, a piezoelectric assembly (15) at one side of the gas valve assembly, a press trigger (13) on top of the piezoelectric assembly, and a crow plate (14) causing both the gas valve assembly and the piezoelectric assembly to act coordinately and coupled between the gas valve assembly and the piezoelectric assembly, and further comprising:

a strengthener (12) between the piezoelectric assembly (15) and the press trigger (13);

a slot including a push key (10) set on the press trigger (13);

a reset spring (11) between the push key (10) and a side wall of the press trigger, and a lobe (20) located at the bottom of push key (10) which has a position corresponding to the top of the strengthener (12).

2. The safety and force saving lighter according to claim 1, wherein the top of the strengthener (12) is propping with the press trigger, the bottom spindle is installed on the casing with a concave bayonet on the middle and the bayonet is seized onto the piezoelectric assembly (15).

3. The safety and force saving lighter according to claim 1, wherein the push key (10) is installed transversely onto two ends of the press trigger and is able to translate front and back along the slot of the press trigger.

4. The safety and force saving lighter according to claim 1, comprising a guide rib (19) on an inner wall of the press trigger and wherein the strengthener (12) includes a circular top surface which is able to move with the guide rib coordinately.

5. The safety and force saving lighter according to claim 1, comprising a stop block (21) fixed onto one side of the lobe (20).

6. The safety and force saving lighter according to claim 2, wherein the push key (10) is installed transversely onto two ends of the press trigger and is able to translate front and back along the slot of the press trigger.

7. The safety and force saving lighter according to claim 2, comprising a guide rib (19) on an inner wall of the press trigger and wherein the strengthener (12) includes a circular top surface which is able to move with the guide rib coordinately.

8. The safety and force saving lighter according to claim 2, comprising a stop block (21) fixed onto one side of the lobe (20).

* * * * *